United States Patent [19]

Draizen et al.

[11] Patent Number: 4,565,237

[45] Date of Patent: Jan. 21, 1986

[54] EXPANDABLE QUENCH SURFACE

[75] Inventors: Seymour Draizen, Old Bridge; Henry J. Sossong, Randolph, both of N.J.

[73] Assignee: Allied Corporation, Morris Township, Morris County, N.J.

[21] Appl. No.: 682,497

[22] Filed: Dec. 18, 1984

Related U.S. Application Data

[63] Continuation of Ser. No. 562,944, Dec. 19, 1983, abandoned, which is a continuation of Ser. No. 244,430, Mar. 16, 1981, abandoned, which is a continuation-in-part of Ser. No. 67,256, Aug. 17, 1979, abandoned.

[51] Int. Cl.[4] ..... B22D 11/06

[52] U.S. Cl. ..... 164/463; 164/423; 164/427; 164/429

[58] Field of Search ..... 164/423, 428, 433, 435, 164/436, 463, 480, 482, 427, 429

[56] References Cited

U.S. PATENT DOCUMENTS

| | | | |
|---|---|---|---|
| 3,537,506 | 11/1970 | Griffiths | 164/429 |
| 4,008,753 | 2/1977 | Properzi | 164/435 |
| 4,033,405 | 7/1977 | Properzi | 164/433 |
| 4,142,571 | 3/1979 | Narasimhan | 164/423 |

*Primary Examiner*—Nicholas P. Godici
*Assistant Examiner*—Richard K. Seidel
*Attorney, Agent, or Firm*—Paul Yee; Gerhard H. Fuchs; James Riesenfeld

[57] ABSTRACT

Metallic filament is continuously cast by directing a stream of molten metal onto the quench surface of a rotating quench wheel. Expansion mechanisms disposed about the quench wheel and between the quench surface and quench wheel drive shaft allow unrestrained radial and lateral thermal growth of the hoop-like quench surface while maintaining concentricity of the quench surface with the shaft. Crowning or thermal bowing of the quench surface is minimized and a transverse cross-sectional uniformity of the cast filament is maintained.

4 Claims, 7 Drawing Figures

EXPANDABLE QUENCH SURFACE

CROSS REFERENCE TO RELATED APPLICATIONS

This application is a continuation of application Ser. No. 562,944, filed Dec. 19, 1983; which, in turn, is a continuation of Ser. No. 244,430, filed Mar. 16, 1981; which, in turn, is a continuation-in-part of Ser. No. 067,256, filed Aug. 17, 1979, all of which now abandoned.

BACKGROUND OF THE INVENTION

This invention relates generally to the substantial reduction of thermal distortion of a continuous casting quench surface. Specifically, this invention provides for lateral and radially unrestrained thermal growth of a hoop-like quench surface of a quench wheel in the continuous casting of glassy alloy filaments.

Extruding a molten alloy from a pressurized crucible through a nozzle onto a rotating quench surface is one of several technologically significant methods available for the continuous casting of continuous glassy alloy filaments, as representatively shown in M. Narasimhan, U.S. Pat. No. 4,142,571 "Continuous Casting Method for Metallic Strips" issued Mar. 6, 1979 hereby incorporated by reference. Typically, such filaments are continuously cast as thin strips, as required to achieve the extreme quench rates in quenching a molten alloy to the glassy state.

To maintain transverse cross-sectional constancy along the length of the strip as cast, it is essential that a geometrically stable quench surface be provided. In this regard, a substantial problem, referred to as "crowning", has been encountered, whereby thermal distortion of the hoop-like quench surface of the quench wheel causes the quench surface to bow radially outward. This distortion is due in part to the fact that the hot quench surface is restrained along its periphery by the cool side disk of the quench wheel ("discontinuity stress"). Thus, in steady-state continuous casting with the quench wheel at thermal equilibrium, the bowing of the quench surface is undesirably induced in the transverse cross-sectional shape of the cast filament.

SUMMARY OF THE INVENTION

The present invention substantially eliminates the problem of quench surface crowning in quench wheel continuous casting by providing for the unrestrained axial (lateral) and radial thermal growth of the hoop-like quench surface in a manner that also maintains concentricity of the quench surface with its shaft of rotation and further provides circumferential support against the torque loads of rotation so that the hot, expanded hooplike quench surface does not slip on its underlying rotative drive disk.

The method of the invention for continuously casting metallic filaments, especially glassy alloy strips, includes the steps of:

(a) directing a stream of molten alloy onto a hoop-like quench surface of a rotating quench wheel; and
(b) allowing unrestrained lateral and radial thermal growth of the quench surface while maintaining its concentricity in a fixed angular relationship with the rotating quench wheel.

The apparatus of the invention for continuously casting metallic filaments by directing a stream of molten alloy onto a rotating quench surface, includes the elements:

(a) a quench wheel having a drive disk mounted for rotation about a shaft and concentrically supporting a hoop-like quench surface; and
(b) expansion means for allowing unrestrained lateral and radial thermal growth of the quench surface while maintaining its concentricity in a fixed angular relationship with the drive disk.

The expansion means preferably comprises at least three radial expansion joints connecting the quench surface and the drive disk, which are symmetrically situated with respect to the shaft of rotation. More preferably, six such expansion joints are utilized.

BRIEF DESCRIPTION OF THE DRAWINGS

Further details are given below with reference to the embodiments shown in the drawings wherein.

DESCRIPTION OF THE PREFERRED EMBODIMENTS

Figure 1:
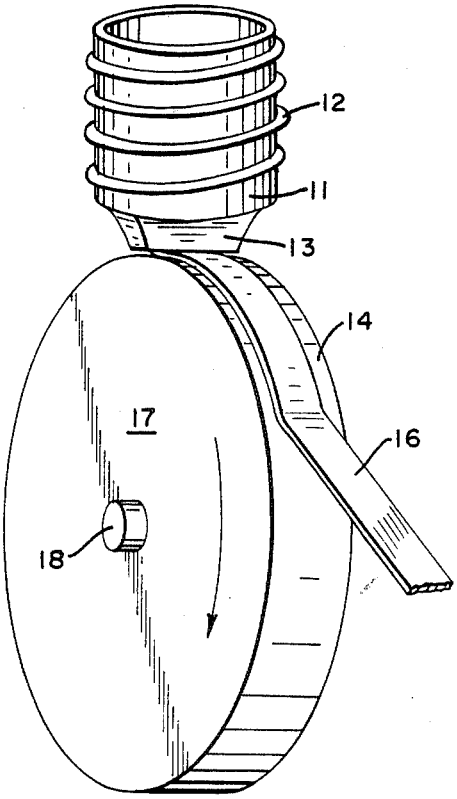
FIG. 1 (PRIOR ART)
FIG. 1 is an illustration of typical prior art apparatus for the continuous casting of glassy alloy continuous filaments in which a molten stream is extruded from a pressurized crucible through an extrusion nozzle onto the quench surface of a rotating quench wheel.

Referring specifically to the drawings, in FIG. 1, typical prior art apparatus for the continuous casting of a glassy alloy filament is illustrated to point out the general use of the present invention. The molten alloy is contained in a crucible 11 provided with a heating element 12. Pressurization of the crucible 11 with an inert gas causes a molten stream to be extruded through a nozzle 13 at the base of the crucible 11 onto a quench surface 14 of a rotating quench wheel 17. The solidified, moving filament 16, after its break away point from the quench surface 14, is typically routed through a tension regulator and finally onto a winder (not shown).

The quench wheel is provided with conventional cooling means (not shown) for maintaining the quench surface at a substantially constant temperature during continuous casting, by contacting the quench surface with a cooling liquid or gas. For example, cooling water may be circulated through the interior of the quench wheel, or the quench surface may be externally spray-cooled.

The quench surface is conventionally made of an alloy, such as beryllium copper, generally having most of the desired characteristics of high thermal conductivity, low thermal expansion, high abrasion resistance, and low chemical reactivity with and high wettability by the extruded melt. Additionally, the high conductivity quench surface may be thinly coated with a high melting ceramic or refractory alloy to improve wear resistance. Other components of the quench wheel may be of any conventional structural alloy, such as a high strength aluminum alloy.

Figure 2:
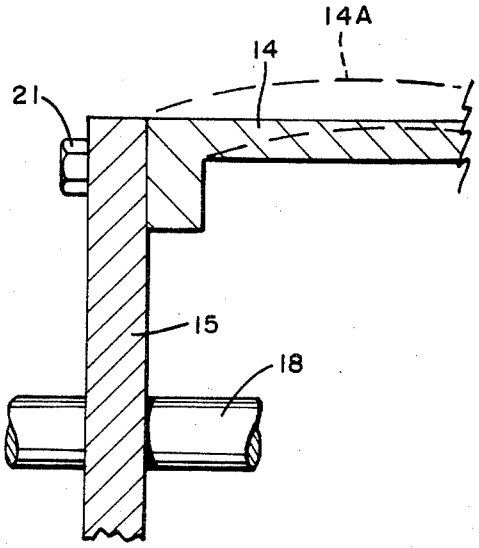
FIG. 2 (PRIOR ART)
FIG. 2 is an axial partial cross-section of the quench wheel illustrating the problem of crowning or thermal-bowing of the hot quench surface as compared to its cold position.

In FIG. 2, a partial cross-section of the quench wheel 17 is shown to illustrate the problem of crowning or thermal-bowing of the quench surface 14. Typically, the hoop-like quench surface 14 is attached to drive disk 15 of quench wheel 17 by conventional rigid joining means, such as a bolt 21. The quench surface 14 at room temperature is desirably flat, but during operation a substantial temperature gradient is developed between the hot quench surface 14 and the cooler drive disk 15 as molten metal is extruded through nozzle 13 onto quench surface 14 to continuously cast filament 16. Thus, thermal expansion causes the quench surface 14 to crown or bow to the position indicated by dashed line 14A, since the lateral edge of the surface is restrained by the cooler drive disk 15 and bolt 21. As a result, the uniformity of the transverse cross-section of the cast filament 16 is adversly affected.

Figure 3:
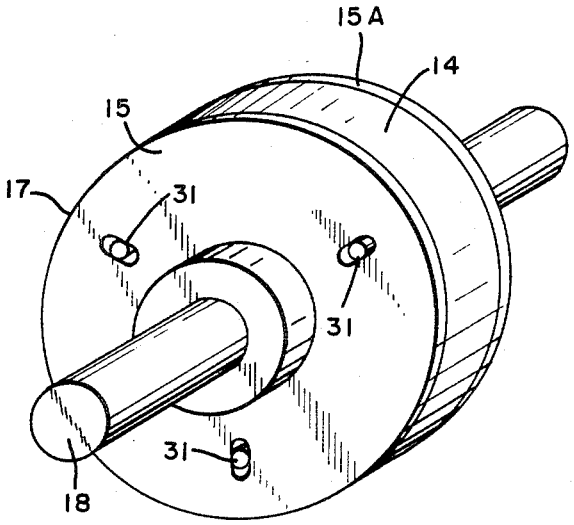
FIGS. 3 and 3A show an embodiment of the present invention, wherein the quench surface is secured to the quench wheel by three sliding-pin radial expansion joints.
Figure 3A:
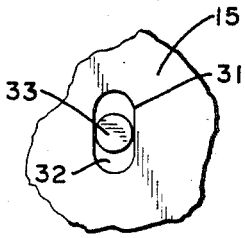

In FIG. 3, an embodiment of the present invention is applied to the conventional quench wheel 17 and comprises three radial expansion joints 31 connecting quench surface 14 and drive disk 15, instead of conventional rigid joining means 21. Disk 15A may be another drive disk or simply a coolant sealing disk. In concept, the radial expansion joints 31 allow unrestrained radial thermal growth of the quench surface 14 while maintaining concentricity of the quench surface 14 with the shaft of rotation 18 and while providing circumferential support against the torque loads of rotation so that the hot, expanded quench surface does not slip on the underlying drive disk 15 during rotation. In FIG. 3A, a detail of one such radial expansion joint is shown which in essence comprises a radially elongated expansion slot 32 in drive disk 15 and laterally receives a close fitting sliding-pin or key 33. Sliding-pin 33 is affixed to the underside of quench surface 14 and is slidably movable in slot 32 as quench surface 14 undergoes radial thermal expansion. On the other hand, sliding-pin 33 is not free to move circumferentially in slot 32 and thus transmits torque loading from the drive disk 15 to the quench surface 14.

At least three such radial expansion joints 31 are required to maintain concentricity of the hoop-like quench surface 14 with the shaft of rotation 18 during radial thermal growth. Further, the radial expansion joints 31 must be symmetrically situated on the drive disk 15 to maintain concentricity of the quench surface 14. For example, the three joints 31 are spaced equiangularly (120° intervals) at equal radial distances from the shaft of rotation 18. Practically speaking, due to machining tolerances there will be some small circumferential slack in each radial expansion joint and therefore some correspondingly small circumferential (rotational) slack of the quench surface 14 with respect to the drive disk 15. This rotational slack may be minimized by increasing the number of radial expansion joints beyond the minimum of three that are fundamentally required to maintain concentricity of the quench surface. Based on statistical consideration of tolerances, it is preferred to use six radial expansion joints symmetrically situated as discussed above.

Figure 4:
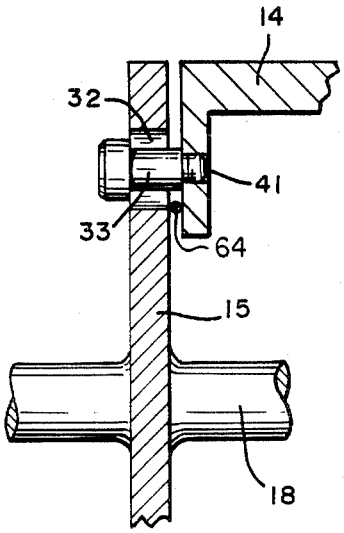
FIGS. 4 and 4A show two embodiments of the sliding-pin expansion joint.
Figure 4A:
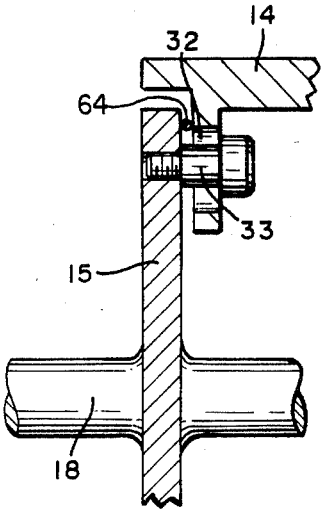

In FIG. 4, a partial cross-section of the quench wheel exposes the lateral details of one embodiment of the radial expansion joint 31. Sliding-pin 33 passes through expansion slot 32 in drive disk 15 and is rigidly received into the underside 41 of quench surface 14. In FIG. 4A, an alternative arrangement of the sliding-pin radial expansion joint is shown wherein the expansion slot 32 is integral to the quench surface 14 and sliding-pin 33 is rigidly received in drive disk 15.

Gap 60, separating quench surface 14 from drive disk 15 permits lateral movement of the quench surface 14 relative to drive disk 15. A sealing means 64, such as silicon rubber or the like, prevents escape of cooling fluid circulated through the interior of the quench wheel during casting. Thermal expansion of quench surface 14 results in axial (lateral) and radial movement thereof relative to drive disk 15. Such axial and radial movement of the quench surface is free of restraint. As a result, crowning or thermal bowing of the quench surface 14 is minimized and transverse cross-sectional uniformity of the cast filament 16 is maintained.

Figure 5:
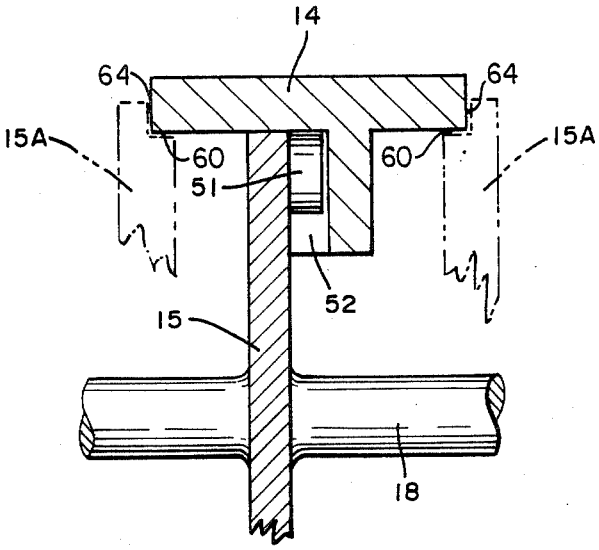
FIG. 5 shows an alternative sliding-key radial expansion joint.

Other embodiments of the radial expansion joint are contemplated in addition to the sliding-pin type. For example, in FIG. 5 a sliding-key type of radial expansion joint is shown. Sliding-key 51 is rigidly secured to the drive disk 15 and is received in expansion groove 52 under quench surface 14. Expansion groove 52 corresponds in shape to sliding-key 51 such that a close fit is obtained. As discussed above, at least three such expansion joints, symmetrically situated, are required to maintain concentricity of the quench surface 14. As in the sliding-pin joint, respective placement of the key and groove may be reversed. Drive disk 15 is shown optionally as supporting quench surface 14 near the center of its underside. Phantom disks 15A are sealing disks for an internal coolant and are separated from quench surface 14 by a gap 60 and sealing means 64. The gap 60 and sealing means 64 cooperate to permit lateral movement of quench surface 14 relative to disks 15A (thereby preventing thermal bowing of the quench surface 14) while preventing escape of the internal coolant during casting.

Having thus described the invention in rather full detail, it will be understood that these details need not be strictly adhered but that various changes and modifications may suggest themselves to one skilled in the art, all falling within the scope of the invention as defined by the subjoined claims.

What is claimed is:

1. Apparatus for continuously casting metallic filaments by directing a stream of molten alloy onto a rotating quench surface, comprising:

(a) a quench wheel having a drive disk mounted between two sealing side disks for rotation about a shaft and concentrically supporting a hoop-like quench surface near the center of the quench surface; and (b) between the quench surface and the drive disk, at least three sliding-pin or sliding-key radial expansion joints for allowing unrestrained lateral and radial thermal growth of said quench surface while maintaining its concentricity in a fixed angular relationship with said drive disk.

2. Apparatus, as in claim 1, further comprising at least six said expansion joints.

3. A method for continuously casting metallic filaments, comprising:

(a) directing a stream of molten alloy onto a hoop-like quench surface which is concentrically supported near its center thereof by a drive disk mounted for rotation about a shaft and located between two sealing side disks of a rotating quench wheel; and (b) allowing unrestrained lateral and radial thermal growth of said quench surface while maintaining its concentricity in a fixed angular relationship with said rotating quench wheel.

4. A method, as in claim 3, wherein said filament is a glassy alloy strip.

* * * * *